US006934493B2

(12) United States Patent
Murakami

(10) Patent No.: US 6,934,493 B2
(45) Date of Patent: Aug. 23, 2005

(54) TONER-SUPPLEMENTING DEVICE AND TONER-AGITATING MEMBER

(76) Inventor: Yukiyoski Murakami, 20-15, Minamihoncho 2-chome, Urawa-shi, Saitama-ken, 336-0118 (JP)

( * ) Notice: Subject to any disclaimer, the term of this patent is extended or adjusted under 35 U.S.C. 154(b) by 190 days.

(21) Appl. No.: 10/614,063

(22) Filed: Jul. 8, 2003

(65) Prior Publication Data

US 2004/0096242 A1 May 20, 2004

(30) Foreign Application Priority Data

Feb. 15, 2002 (JP) ..... 2002-38724

(51) Int. Cl.[7] ..... G03G 15/08
(52) U.S. Cl. ..... 399/258; 399/260
(58) Field of Search ..... 399/254, 255, 399/256, 258, 259, 260, 263

(56) References Cited

U.S. PATENT DOCUMENTS 5,345,298 A * 9/1994 Corrigan, Jr. ..... 399/260

* cited by examiner

*Primary Examiner*—Hoang Ngo

(57) ABSTRACT

In order to develop a toner-supplementing device and a toner-agitating member used in an image forming device which are small in size, superior in their maintenance and image quality as well as their operability and have no dispersion in supplying of toner, the toner-supplementing device of the present invention is made such that a toner-storing segment is placed outside an image-forming range of the image-forming device, toner is transferred from the toner-storing segment to a toner-supplementing segment of a developer device and the toner is supplemented to a toner-supplementing area having a predetermined width at the toner-supplementing segment, wherein there are provided a conduit having an upstream side one end fixed to the developer device; a cylindrical member closely contacted with the other end of the conduit, rotatable around its axis, having its central segment being placed on an inclined line in respect to an axial direction in a developed plane of a circumferential wall segment and having a desired number of small slit-like toner-supplementing ports punched with their phase being displaced in a circumferential direction and in parallel with the axial direction; and a toner-transferring member for transferring the toner from the upstream one end toward the other downstream end inside the toner-supplementing cylindrical member.

12 Claims, 13 Drawing Sheets

TONER-SUPPLEMENTING DEVICE AND TONER-AGITATING MEMBER

BACKGROUND OF THE INVENTION

1. Field of the Invention

This invention relates to an improvement of a toner-supplementing device in an image-forming device such as a printer, copying machine and facsimile or the like having a toner-storing unit out of an image-forming range so as to transfer and supplement toner from the toner-storing unit to a toner-supplementing unit of a developer device, and an improvement of a toner-agitating member used in the toner-supplementing device.

2. Description of the Related Art

In the prior art toner-supplementing unit in the image-forming device, it is generally applied to have a method for installing a toner cartridge, for example, as a toner-storing unit having substantially the same length in regard to an axial direction of the toner-supplementing roller and dropping toner directly from the toner cartridge to a predetermined width of the toner supplementing unit storing the toner-supplementing roller of the developer device because the toner must be uniformly dispersed and supplemented against the toner-supplementing roller for supplementing the toner to the upper part of the developer device over a width corresponding to an image-forming range, i.e. to a latent image carrier through the developer agent carrier.

However, it is required to extend a time in which the toner reaches a toner end as long as possible because a supplementing of toner when the toner in the aforesaid toner-supplementing unit is completely consumed or replacement of a toner cartridge and toner bottle or the like are a troublesome work. As a measure, attempts are made to increase a storing amount of toner.

In addition, although the devices disclosed in the gazette of Japanese Patent Laid-Open No. Sho 60-84556 and the gazette of Japanese Patent Laid-Open No. Hei 7-199625, for example, have already been provided as the toner-supplementing device, these devices are a device for transferring toner in both directions to cause the toner to be circulated over a substantial same width as that of the toner-supplementing roller or a device for transferring the toner in a semi-forced manner.

SUMMARY OF THE INVENTION

The structure using the aforesaid prior art developer device and the toner-storing unit had a problem that a size of the developer device was increased as a storing amount of toner was increased and in particular in the case of a tandem full-color image-forming device or the like, four developer devices were installed to cause a large-sized formation of the device to be promoted. In addition, the method for dropping toner to a predetermined width of the toner-supplementing unit had a problem that toner was leaked at the time of replacement of the toner cartridge to cause an operator to stain his or her hands or to cause the device to be stained because a size of a toner-receiving port was large and this disadvantage should be overcome in view of operation and repair or maintenance work for the device.

In the case of the devices described in the gazette of Japanese Patent Laid-Open No. Sho 60-84556 and the gazette of Japanese Patent Laid-Open No. Hei 7-199625, they showed a problem that an image was badly influenced due to deterioration of toner caused by an excessive agitation or a problem that an amount of storage of toner at both ends of the toner-supplementing unit was increased to cause a pressure of toner to be increased and bad influence to be applied to the image because the toner was uniformly supplemented over an entire width in such a way that the toner was always adapted for the maximum width medium specified for the device without being related to a size of the medium such as a paper to be printed.

It is an object of the present invention to overcome the various problems of the prior art described above and to provide a small-sized toner-supplementing device used in an image-forming device having a superior operating characteristic, superior maintenance and image quality and having no dispersion in supplying of toner and a convenient toner-agitating member used in the toner-supplementing device.

DETAILED DESCRIPTION OF THE PREFERRED EMBODIMENTS

Figure 1:
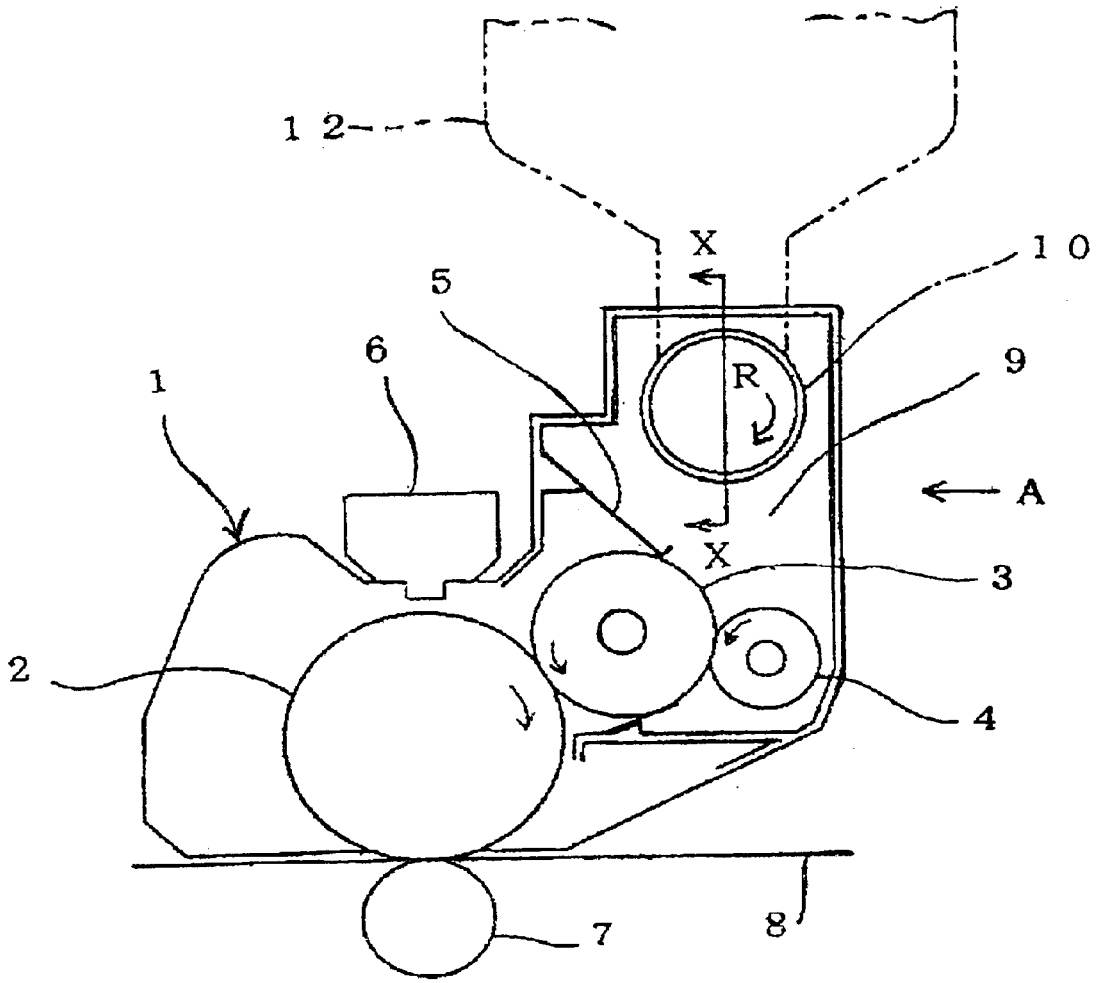
FIG. 1 is a schematic side elevational view for showing an inside part of a developer device having a toner-supplementing device and a toner-agitating member in accordance with a first embodiment to a third embodiment of the present invention.

Referring now to the drawings, some embodiments of the present invention will be described as follows.

The embodiments herein disclosed in the present invention are embodiments in which a removable toner cartridge is applied to the toner-supplementing device arranged in the developer device of an electrophotographic type image forming device (hereinafter abbreviated as an image forming device), wherein some components common in each of the figures are denoted by the same reference symbols and their detailed description will be eliminated. In addition, hatching at the sectional part in the certain figures is eliminated for avoiding a complicated display.

Figure 2:
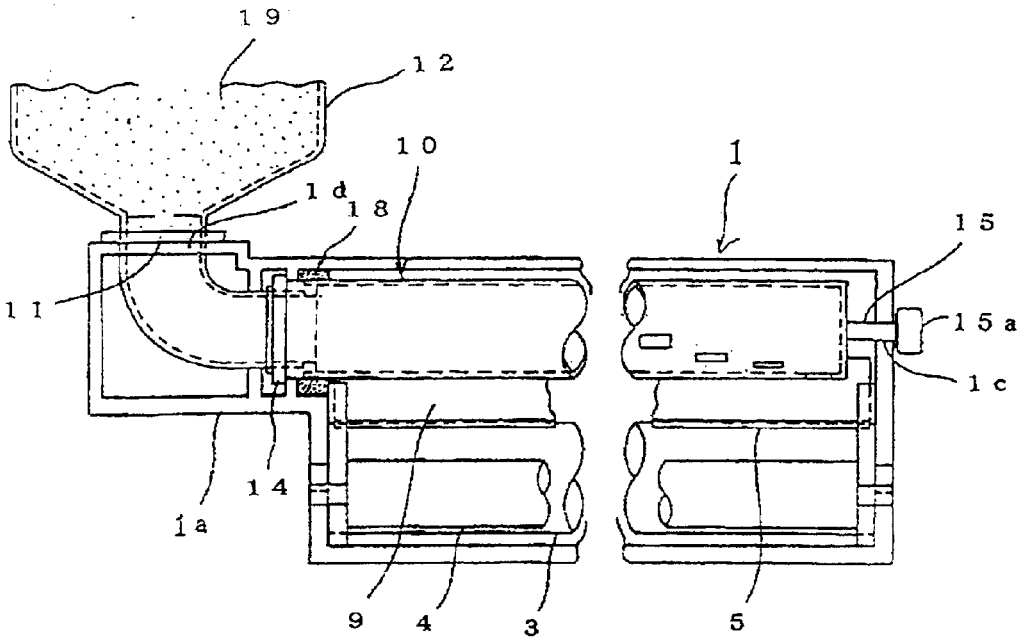
FIG. 2 is a schematic front elevational view seen from a direction of an arrow A inside the developer device shown in FIG. 1.

In FIGS. 1 and 2, reference numeral 1 denotes a developer device; 2 denotes a photo-sensitive drum acting as a latent image carrier; 3 denotes a developer roller acting as a toner carrier; 4 denotes a toner-transferring roller for use in transferring toner to the developer roller 3; 5 denotes a developer blade for uniformly making toner on the developer roller 3 thin; 6 denotes an LED head for exposing light and forming an electrostatic latent image on the photo-sensitive drum 2; and 7 denotes a transferring roller for transferring the toner image formed on the photo-sensitive drum 2 onto a printing medium 8 such as a paper and the like. Then, the developer device 1 has a hopper 9 formed with a space acting as a toner-supplementing section for use in supplementing toner to the toner transferring roller 4. A toner-supplementing device 10 according to the present invention is arranged at an upper part of the hopper 9. Reference numeral 11 denotes a supplying side connecting member at a toner cartridge side; and 12 denotes a toner cartridge acting as a toner-storing section. Although not shown, the supplying side connecting member 11 is formed with a toner-supplying port punched therein to be described later. The hopper 9 has no capacity for storing much amount of toner and the hopper is arranged at a front side of the developer device (the right side in FIG. 1 and a front side in the paper in FIG. 2).

Figure 3A:
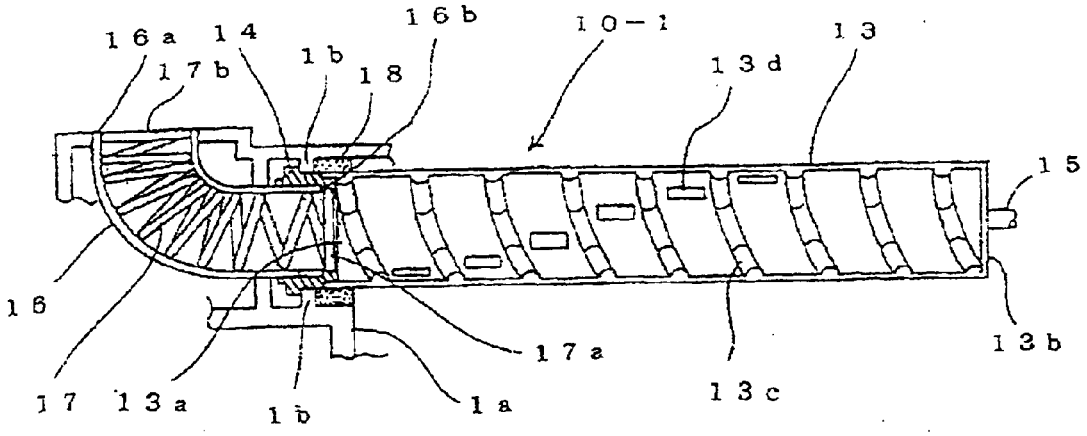
FIGS. 3(*a*) and 3(*b*) is a sectional view taken along line X—X of the first embodiment of the toner-supplementing device of the present invention, wherein FIG. 3(*a*) is an entire view and FIG. 3(*b*) is a partial view for showing a fixing part between a conduit and a bushing.
Figure 3B:
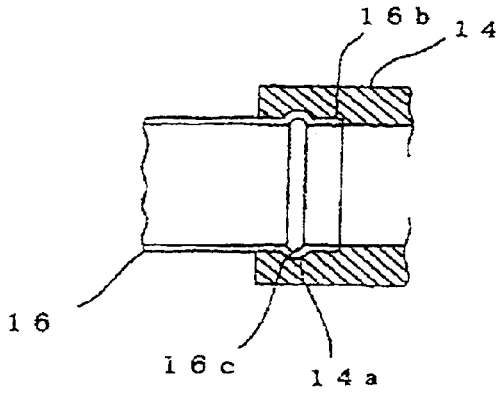

At first, referring to FIGS. 2 to 4, a toner-supplementing device 10-1 in accordance with a first embodiment of the present invention will be described.

The toner-supplementing device 10-1 is installed between the toner cartridge 12 and the hopper 9, and has a toner-supplementing cylindrical member 13, conduit 16, coil spring 17, bushing 14 and seal member 18.

The toner-supplementing cylindrical member 13 is a cylinder having an opening end 13*a* at its one end (a toner-supplementing upstream side, the left side in FIG. 3, which are similarly applied to each of the following descriptions), and this is arranged substantially in a horizontal orientation so as to oppositely face against the toner-transferring roller 4. A length of the toner-supplementing cylindrical member 13 in its axial direction is set to be substantially the same axial length of the toner-transferring roller 4. Then, the opening end 13*a* is fixed to the ring-shaped bushing 14. The bushing 14 is rotatably engaged with a bearing 1*b* integrally formed at the frame 1*a* of the developer device 1. A driving shaft 15 integrally formed at a center of the cylinder outside the opening end 13*b* arranged at the other end (a toner-supplying downstream side, the right side in FIG. 3, which are similarly applied to each of the descriptions below) is rotatably engaged with a bearing hole 1*c* formed at the frame 1*a*, and this is further connected to a coupling 15*a* acting as a rotating force transmission means outside the frame 1*a* as shown in FIG. 2. A circumferential wall part of the toner-supplementing cylindrical member 13 is provided with toner-feeding protrusions 13*c* and toner-supplementing ports 13*d* described in detail as follows.

The conduit 16 is made of tubular material, bent into an elbow shape by 90°, one end 16*a* of the conduit is fixed to a lower side of a toner-receiving port 1*d* formed at the upper part of the frame 1*a* of the developer device 1 and the other end 16*b* of the conduit is engaged with a ring-like inner surface of the bushing 14. In order to attain this engaged state, a ring-like small protrusion 16*c* is formed at an outer circumferential surface of the other end 16*b* of the conduit 16 as shown in FIG. 3(*b*), an engaging cavity 14*a* is formed at a ring-like inner wall of the bushing 14 in such a way that it may be engaged with the small protrusion 16*c*, the small protrusion 16*c* and the engaging cavity 14*a* are engaged with each other. The conduit 16 and the bushing 14 cannot be pulled out in an axial direction, the bushing 14 can be rotated around an axis of the other end 16*b* of the conduit 16 and this is effective for preventing a dispersion of toner. Further, in order to reinforce a prevention of dispersion of toner, it is also applicable to hold a seal material having a low coefficient of friction such as a foamed rubber or the like between the bushing 14 and the conduit 16. Due to this arrangement, the conduit 16 and the toner-supplementing cylindrical member 13 are closely contacted to each other, and the toner-supplementing cylindrical member 13 is rotatably supported around the axis.

Figure 13A:
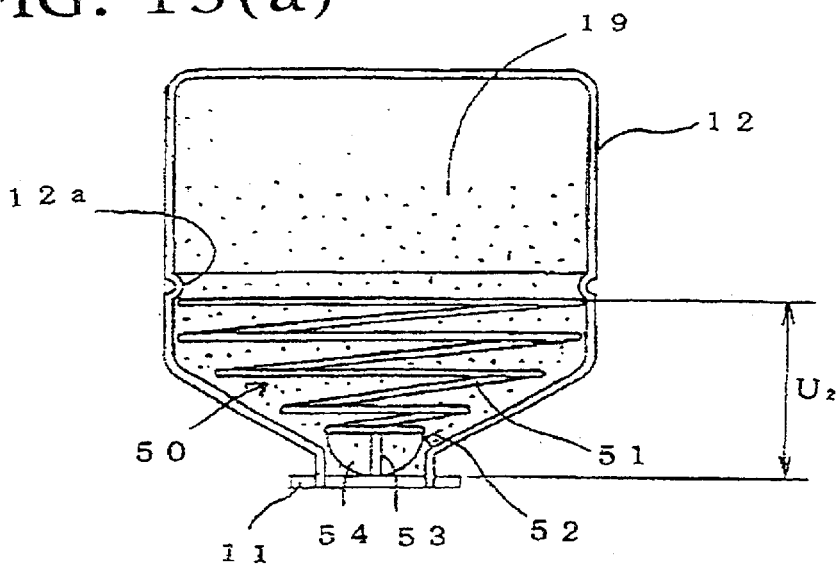
FIG. 13(*a*) is a longitudinal sectional view for showing a toner cartridge, FIG. 13(*b*) is an inverted perspective view for showing an extremity end of the toner-agitating member and FIG. 13(*c*) is a top plan view for showing one end of a coil spring having one example of the toner-agitating member of the present invention.
Figure 13B:
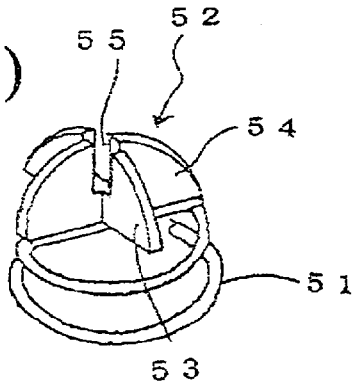
Figure 13C:
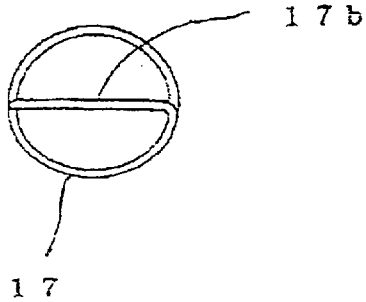

Reference numeral 17 denotes a coil spring wound in a clockwise direction having a slightly smaller outer diameter than an inner diameter of the conduit 16, wherein one end 17*b* is formed in a linear-shape as shown in FIG. 13(*b*) to be described later and the other end 17*a* is fixed to the bushing 14 and rotatable around the center of the shaft. Reference numeral 18 denotes a seal member fixed to the frame 1*a* so as to prevent leakage of toner and seal against the bushing 14 and an outside part of the opening end 13*a* of the toner-supplementing cylindrical member 13. As its material, selection of material having a low coefficient of friction at its surface enables a rotating load of the toner-supplementing device to be reduced.

Next, referring to FIG. 4, the circumferential wall of the toner-supplementing cylindrical member 13 will be described in detail. Helical toner-feeding protrusions 13*c* (wound in a clockwise direction) having a minute height are projected or protruded at an inner surface of the circumferential wall of the toner-supplementing cylindrical member 13, and a desired number of small-slit type toner-supplementing ports 13*d* spaced apart by the toner-feeding protrusions 13*c* are punched in a range L of axial direction of the toner-supplementing cylindrical member 13 corresponding to a predetermined width of the toner-feeding roller 4 (a length in the axial direction) to which the toner should be supplemented. Although an area, arrangement and number of the toner-supplementing ports 13*d* in this case are properly determined or set in reference to some specifications such as a fluidity of toner or the like, or a toner-feeding test and the like, these toner-supplementing ports are punched while being normally spaced apart by an equal distance from each other, with a phase of the circumference of the toner-supplementing cylindrical member 13 being displaced by only an angle substantially divided into an equal value of the desired number and all of each of the areas of the ports being set to the same value to each other. That is, one toner-supplementing port 13*d* can be operated while the toner-supplementing cylindrical member 13 is being rotated once within a length range L of the toner-supplementing cylindrical member 13 and at each of the positions substantially equally spaced apart. Although the toner-feeding protrusions 13*c* are effective for performing a smooth feeding of toner, either a coil spring or an auger to be described later in place of these toner-feeding protrusions can be used, and the coil spring and auger constitute the toner-feeding member.

Figure 4:
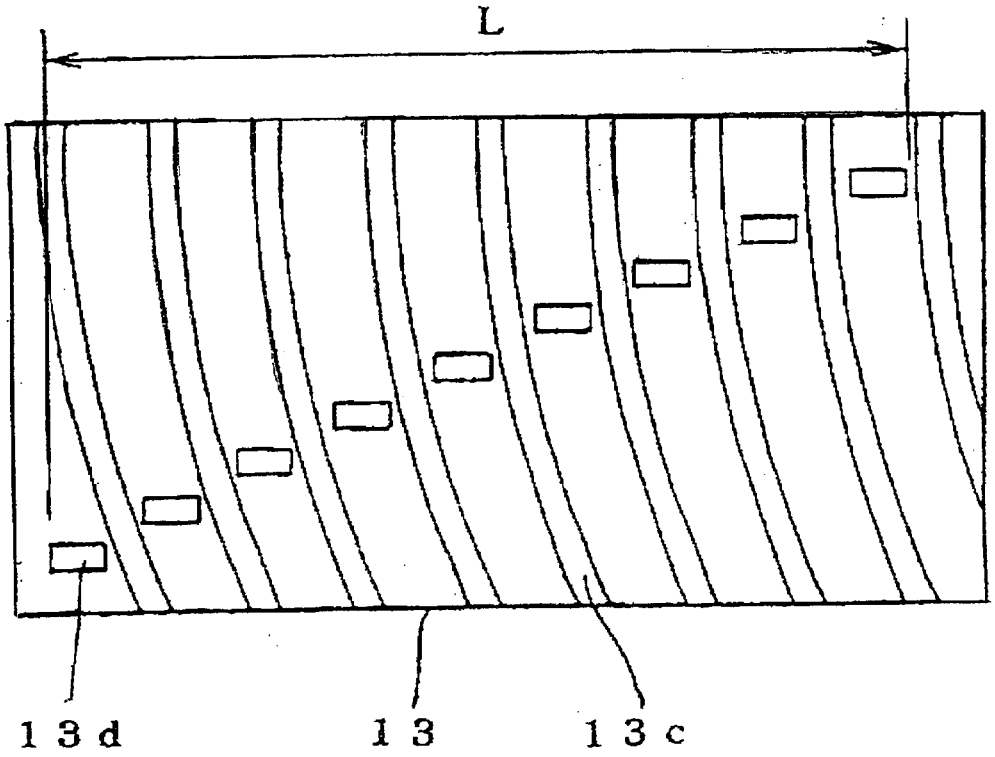
FIG. 4 is a developed view for showing a toner-supplementing cylindrical member of the toner-supplementing device shown in FIGS. 3(*a*) and 3(*b*).

In addition, although the centers of the toner-supplementing ports 13*d* are placed on an inclined line in one direction (the rightward and upward direction in this embodiment) in respect to an axial direction in a developed plane of the circumferential wall shown in FIG. 4 and the small slit-like toner-supplementing ports are punched in parallel with the axial direction, it may also be applicable that the centers are not placed necessarily on the inclined-line in one direction, but the centers of the toner-supplementing ports are arranged on the inclined lines in two directions crossed with each other in a tucked-up state. However, since their constitution becomes slightly complex, it is preferable that the toner-supplementing ports are placed on an inclined line of one direction as disclosed in the present embodiment.

Further, in the present invention, the shape of toner-supplementing port 13*d* includes not only small slit-like-shape but also oval hole-shape, circular hole-shape and the shape of small circular holes put in a row.

Operation of the toner-supplementing device 10-1 of the first embodiment of the present invention will be described as follows.

The developer device 1 is installed at an image-forming device not shown and the coupling 15*a* is connected with a source of power for a control means for the image-forming device. Then, as shown in FIG. 2, when the toner cartridge 12 is mounted above the toner-receiving port 1*d* of the developer device 1, the stored toner 19 drops into the conduit 16 through the supplying port of the toner cartridge 12.

When the coupling 15*a* is driven, the coil spring 17 is rotated in a clockwise direction R as shown in FIG. 1 together with the toner-supplementing cylindrical member 13 connected to the coupling 15*a*. The toner 19 dropped into the conduit 16 under rotation of the coil spring 17 is transferred into the downstream side toner-supplementing cylindrical member 13. Further, the toner 19 transferred into the toner-supplementing cylindrical member 13 drops in sequence into the hopper 9 from the corresponding toner-supplementing ports 13*d* in a substantially vertical downward direction while the toner 19 is being transferred by the toner-feeding protrusions 13*c* to a downstream side direction of the toner-supplementing cylindrical member 13. Then, the toner 19 does not drop during a time in which the toner-supplementing ports 13*d* are not positioned in a vertical downward direction, and the toner 19 is further transferred to the downstream side of the toner-supplementing cylindrical member 13.

Next, referring to FIGS. 5 and 6, a toner-supplementing device 10-2 of a second embodiment of the present invention will be described as follows.

Figure 5A:
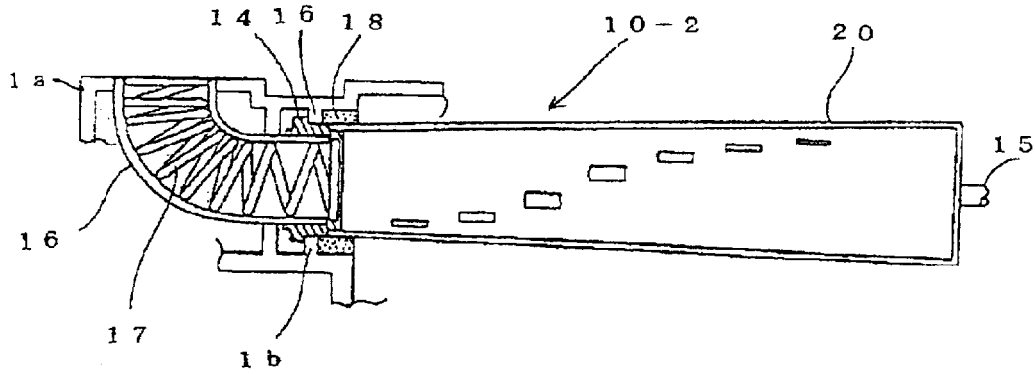
FIG. 5(*a*) is a sectional view taken along line X—X of a second embodiment of the toner-supplementing device of the present invention and FIG. 5(*b*) is a sectional view for showing the toner-supplementing cylindrical member of a modified example of FIG. 5(*a*).
Figure 5B:
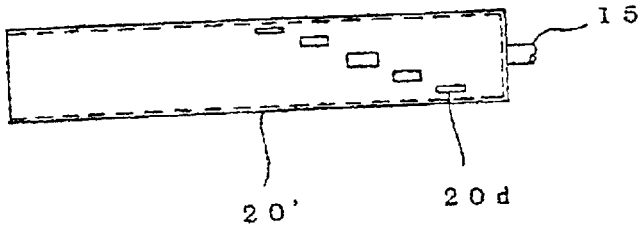
Figure 6:
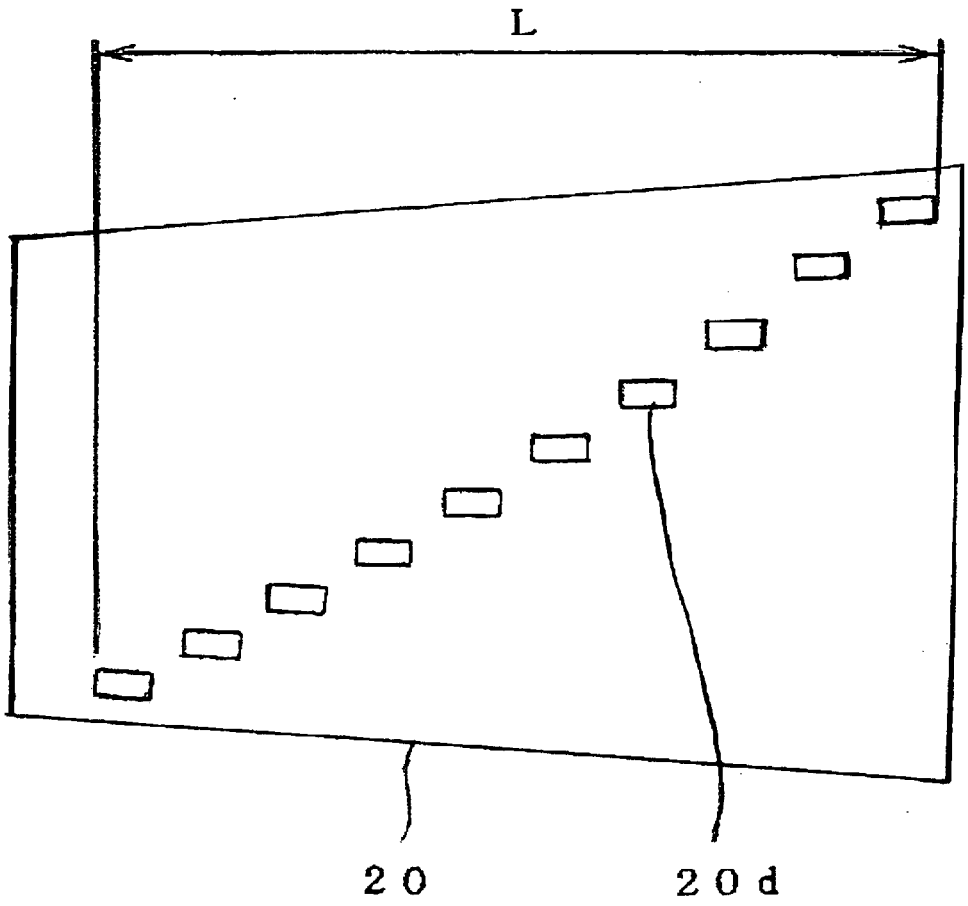
FIG. 6 is a developed view for showing a toner-supplementing cylindrical member of the toner-supplementing device shown in FIGS. 5(*a*) and 5(*b*).

In FIG. 5(*a*), a toner-supplementing cylindrical member 20 is a conical cylinder of which diameter is reduced continuously and gradually from one opened end toward a downstream direction where the toner 19 is transferred. Then, as shown in a developed view of FIG. 6, the toner-supplementing cylindrical member 20 has some toner-supplementing ports 20*d* arranged within a length range L of the toner-supplementing cylindrical member 20 in the same manner as that of the toner-supplementing device 10-1 of the first embodiment.

Further, as a modified embodiment of the toner-supplementing device 10-2 of the second embodiment, it may also be applicable that a toner-supplementing cylindrical member 20' of the cylinder having the same diameter over its entire length is inclined as shown in FIG. 5(*b*) and a circumferential wall position is arranged to descend toward the toner-transferring downstream direction. An angle of inclination can be set large when it is desired to set it large in response to a desired transferring amount of toner.

Operation of the toner-supplementing device 10-2 and operation of its modified embodiment are carried out such that when the developer device 1 is installed at the image forming device and the coupling 15*a* is driven by the source of power through the control means in the same manner as that of the toner-supplementing device 10-1, the coil spring 17 is rotated in a clockwise direction together with either the toner-supplementing cylindrical member 20 or 20' and then the toner drops in sequence into the hopper 9 from the corresponding toner-supplementing port 20*d* in a substantially vertical downward direction while being transferred toward the downstream direction from within the conduit 16 into either the toner-supplementing cylindrical member 20 or 20'.

Next, referring to FIGS. 7 and 8, a toner-supplementing device 10-3 of a third embodiment of the present invention will be described as follows.

Figure 7:
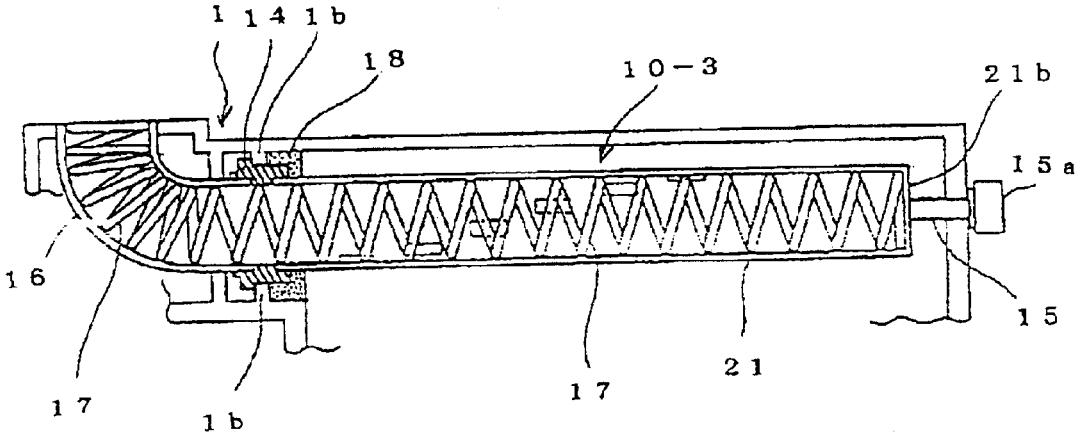
FIG. 7 is a sectional view taken along line X—X of a third embodiment of the toner-supplementing device of the present invention.

In FIG. 7, the toner-supplementing cylindrical member 21 has a substantial same inner diameter as that of the conduit 16. Then, the coil spring 17 having its outer diameter slightly smaller than an inner diameter of each of the toner-supplementing cylindrical member 21 and the conduit 16 is extended over the entire length of the conduit 16 and toner-supplementing cylindrical member 21, and the other end 17*a* of the coil spring 17 is fixed to the inner wall of the closed end 21*b* of the toner-supplementing cylindrical member 21. Further, the coil spring 17 in the toner-supplementing cylindrical member 21 may be replaced by an auger as a modified embodiment of the third embodiment.

Figure 8:
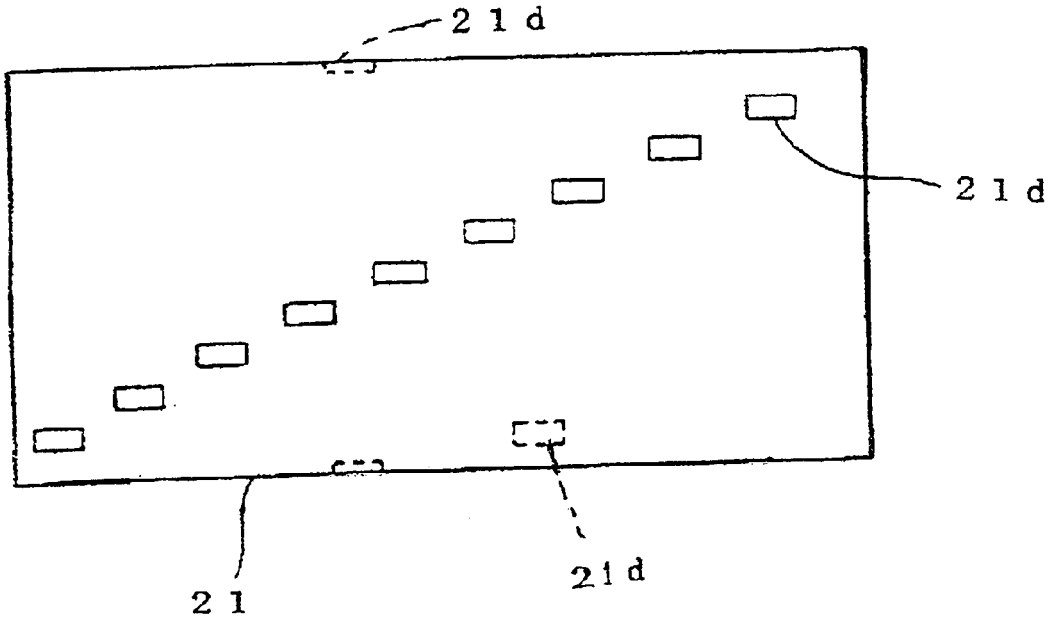
FIG. 8 is a developed view for showing a toner-supplementing cylindrical member of the toner-supplementing device shown in FIG. 7.

As illustrated in the developed view of FIG. 8, the toner-supplementing cylindrical member 21 has some toner-supplementing ports 21*d* arranged in the same manner as that of the toner-supplementing device 10-1. Further, when it is desired to provide that an amount of consumption of toner at a central part of the toner-transferring roller 4 in its longitudinal direction is larger than that at both ends of the roller, it may also be applicable that some toner-supplementing ports 21*d* at the central part are incremented as illustrated by a dotted chain line.

Operation of the toner-supplementing device 10-3 is performed in the same manner as that of the toner-supplementing device 10-1. As the developer device 1 is installed at the image forming device and the coupling 15*a* is driven from the source of power by the control means, the coil spring 17 is rotated in a clockwise direction together with the toner-supplementing cylindrical member 21 and the toner 19 drops in sequence into the hopper 9 from the corresponding toner-supplementing ports 21*d* in a substantial vertical downward direction while the toner 19 is being transferred from within the conduit 16 in a downstream direction in the toner-supplementing cylindrical member 21.

Then, referring to FIGS. 9 to 12, a toner-supplementing device 10-4 of a fourth embodiment of the present invention will be described as follows.

Figure 9:
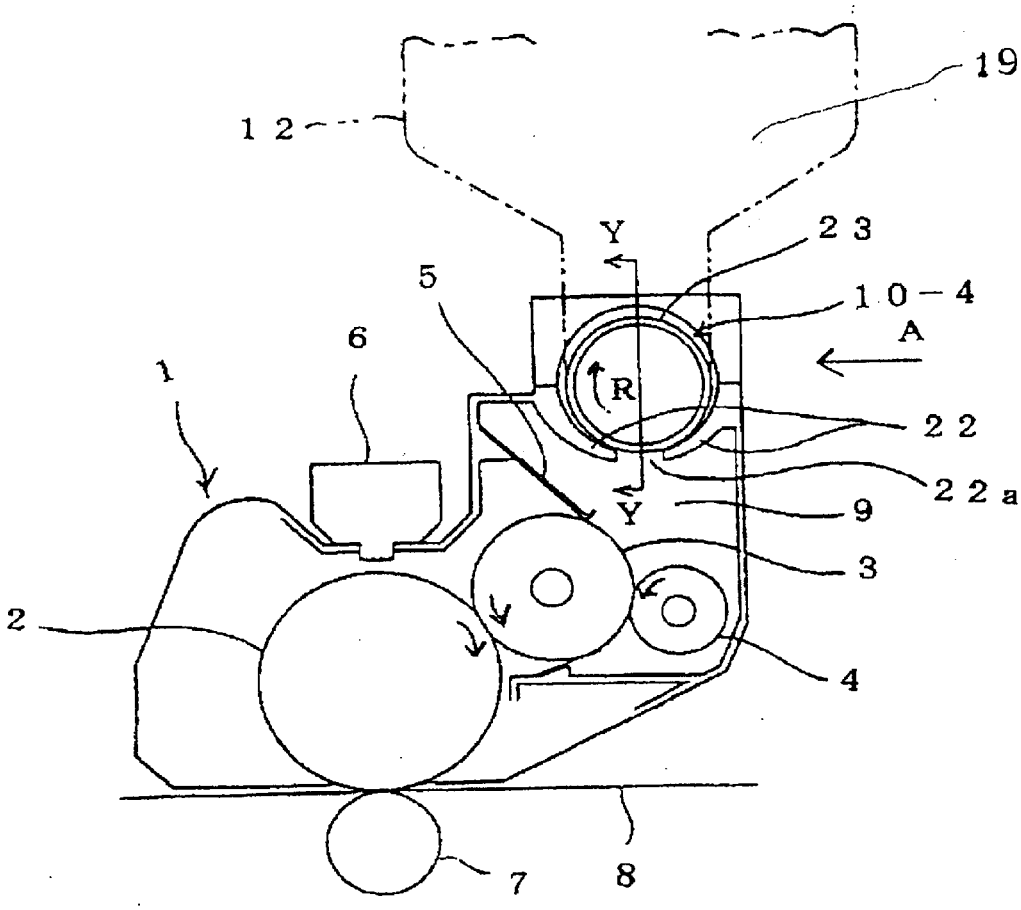
FIG. 9 is a schematic side elevational view for showing an inside part of a developer device having a toner-supplementing device and a toner-agitating member in accordance with a fourth embodiment of the present invention.
Figure 10:
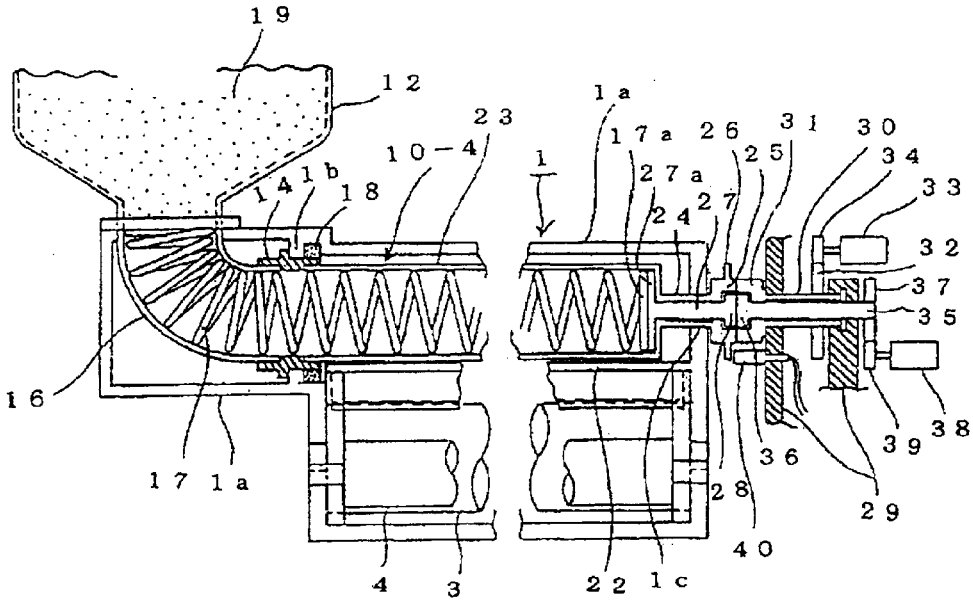
FIG. 10 is a schematic front elevational view seen from a direction of arrow A inside the developer device shown in FIG. 9 and includes a sectional view taken along line Y-Y of a fourth embodiment of the toner-supplementing device.

In FIGS. 9 and 10, reference numeral 22 denotes a partition wall for defining between the toner-supplementing device 10-4 and the hopper 9 of the toner-supplementing segment. The partition wall 22 is provided with an opening 22*a* having such a size as one corresponding to a predetermined width in an axial direction and a predetermined width in a circumferential direction in which the toner is desired to be supplemented to the toner-transferring roller 4.

The toner-supplementing cylindrical member 23 is arranged with its outer circumferential surface being slightly spaced apart against an upper surface of the partition wall 22, a shaft 24 at a closed end 23*b* of the toner-supplementing cylindrical member 23 is a hollow shaft, rotatably engaged with a bearing hole 1*c* formed at the frame 1*a* and a coupling 25 acting as a rotating power force transmission means is arranged outside the frame 1*a*. The coupling 25 is provided with a disk-like marker member 26 for use in displaying a phase position of the toner-supplementing cylindrical member 23. Further, it may also be applicable in a form that, in place of the partition wall 22, a pipe member having an inner diameter slightly larger than an outer diameter of the toner-supplementing cylindrical member 23 and having the same opening as the opening 22*a* opened in the partition wall 22 is fixed (not rotatable) and arranged and then the toner-supplementing cylindrical member 23 is inserted into the pipe member.

Then, the coil spring 17 having its outer diameter slightly smaller than an inner diameter of each of the toner-supplementing cylindrical member 23 and the conduit 16 is extended over an entire length of the conduit 16 and toner-supplementing cylindrical member 23, and the other end 17*a* of the coil spring 17 is fixed to a flange 27*a* of a shaft 27 having a flange in the same manner as that of the toner-supplementing device 10-3. The shaft 27 having the flange is rotatably engaged with the hollow part of the shaft 24 of the toner-supplementing cylindrical member 23, and a coupling 28 acting as a rotating power force transmission means is arranged at the other end of it. In addition, the coil spring 17 in the toner-supplementing cylindrical member 21 may be replaced by an auger in the same manner as the third embodiment.

A first driving shaft 30 of hollow structure is rotatably pivoted at a bearing arranged at a frame 29 of the image-forming device, a coupling is arranged at the first driving shaft 30 in an inside direction of the image-forming device and a gear 32 is fixed to the other end of it. Then, the gear 32 is engaged with a gear 34 fixed to a shaft of a stepping motor 33. A second driving shaft 35 is rotatably engaged with a hollow part of the first driving shaft 30, a coupling 36 is arranged at one end, a gear 37 is arranged at the other end, and the gear 37 is engaged with a gear 39 fixed to the shaft of the stepping motor 38.

A sensor 40 is installed at the frame 29 of the image-forming device so as to enable a phase position data about the toner-supplementing cylindrical member 23 displayed at the marker member 26 to be detected.

Figure 11:
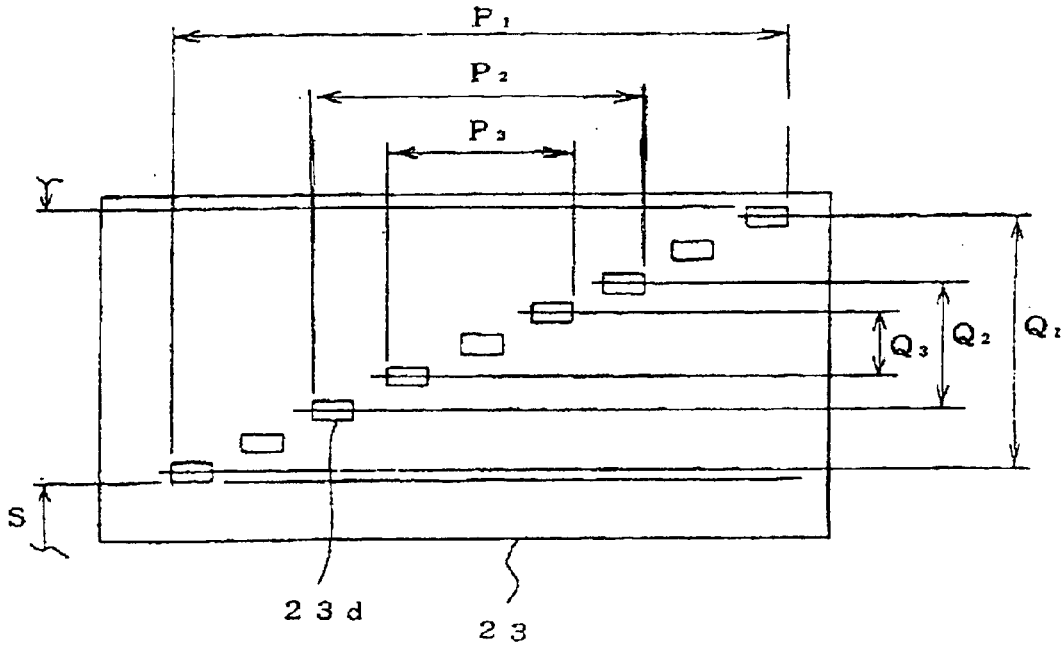
FIG. 11 is a developed view for showing the toner-supplementing cylindrical member of the toner-supplementing device shown in FIG. 10.

As shown in the developed view of FIG. 11, the toner-supplementing cylindrical member 23 forms a range S where the toner-supplementing ports 23*d* are not provided over a width slightly wider than a predetermined width in a circumferential direction of the opening 22*a* of the partition wall 22 arranged above the hopper 9 and over an entire width in an axial direction at one location on the circumferential surface of the toner-supplementing cylindrical member 23.

Figure 12:
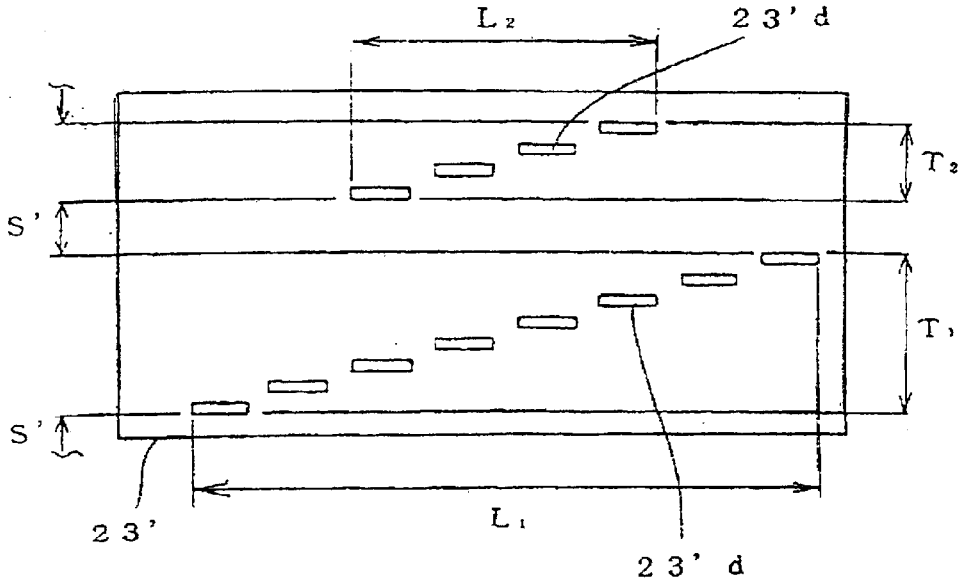
FIG. 12 is a developed view for showing a modification of the toner-supplementing cylindrical member of the toner-supplementing device shown in FIG. 10.

Then, as shown in the developed view of FIG. 12, the toner-supplementing cylindrical member 23' as a modified embodiment of the toner-supplementing cylindrical member 23 forms a range S' having no toner-supplementing ports 23'*d* in a width slightly wider than the predetermined width in a circumferential direction of the opening 22*a* of the partition wall 22 arranged above the hopper 9 and over an entire width in an axial direction at two locations of substantial symmetrical positions on the circumferential surface and the circumferential surface of the toner-supplementing cylindrical member 23' is defined into a range T1 and a range T2 by two location ranges S'. Within the range T1, the toner-supplementing ports 23'*d* are arranged in the longitudinal range L1 of the toner-supplementing cylindrical member 23' corresponding to a printable range of a wide printing medium 8 to which the image forming device prints. In turn, within the range T2, the toner-supplementing ports 23'*d* are arranged in the longitudinal range L2 of the toner-supplementing cylindrical member 23' corresponding to a printable range of a narrow printing medium 8 to which the image forming device prints. It may also be applicable that the number of defined segments of the toner-supplementing cylindrical member 23' are 3 or more.

Operation of the toner-supplementing device 10-4 under application of the toner-supplementing cylindrical member 23 is carried out such that the developer device 1 is installed at the image forming device in the same manner as that of the toner-supplementing device 10-1, the coupling 25 arranged at the developer device 1 is connected to the coupling 31 at the image-forming device, and the coupling 28 arranged at the developer device 1 is connected to the coupling 36 at the image forming device. Then, the sensor 40 at the image-forming device is placed in opposition to the marker member 26.

As shown in FIG. 10, when the toner cartridge 12 is installed at the toner-receiving port 1*d* of the developer device 1 in this case, the toner 19 stored in the toner cartridge 12 drops into the conduit 16.

Next, when a power supply for the image-forming device not shown is turned on, the stepping motor 33 starts a driving action through a source of power by means of a control means of the image-forming device and the stepping motor 33 stops its driving action when the range S of the toner-supplementing cylindrical member 23 opposes against the opening 22*a* of the partition wall 22.

Next, the stepping motor 38 is driven for a predetermined time, the coil spring 17 is turned in a clockwise direction R and the toner 19 is transferred in the toner-supplementing cylindrical member 23. Then, the stepping motor 33 is driven to supplement in sequence the toner 19 from the corresponding toner-supplementing port 23*d* in a vertical downward direction while the stepping motor 38 is being continued to be driven. As another operation, it is also possible to perform a simultaneous driving operation of the stepping motors 33 and 38 and supplement the toner 19.

A start-up at a customer's site can be made fast when the image-forming device is installed, i.e. the image-forming device can be set to its printable state fast by a method wherein the toner 19 is filled in advance in the toner-supplementing cylindrical member 23 under a state where the toner-supplementing port 23*d* is kept closed in the range S of the toner-supplementing cylindrical member 23 when the device is delivered from its manufacturing factory.

Operation of the toner-supplementing device 10-4 under application of the toner-supplementing cylindrical member 23' of the modified embodiment is carried out such that when the developer device 1 and the toner cartridge 12 are installed at the image-forming device in the same manner as that of the toner-supplementing device 10-4, its power supply is turned on and a printing instruction for a wide printing medium 8 is outputted from a control means upon completion of supplementing of toner 19 in the hopper 9 of the developer device 1, the stepping motor 38 is driven and a normal rotation or reverse rotation of the stepping motor 33 is repeated in such a manner that the range T1 of the toner-supplementing cylindrical member 23' is positioned below while the coil spring 17 is being rotated in a downstream transferring direction of the toner and each of the toner-supplementing ports 23'*d* in the range T1 repeats its accommodation in sequence in a vertical direction. The toner 19 is supplemented into the hopper 9 of the developer device 1 oppositely facing against the range L1 of the toner supplementing cylindrical member 23. In turn, in the case that the printing instruction for the narrow printing medium 8 is outputted from the control means, the stepping motor 38 is driven and a normal rotation or a reverse rotation of the stepping motor 33 is repeated in such a way that the range T2 of the toner-supplementing cylindrical member 23' is positioned below while the coil spring 17 is being rotated in a downstream transferring direction of the toner, and each of the toner-supplementing ports 23'*d* in the range T2 repeats an accommodation in a vertical direction in sequence. The toner 19 is supplemented into the hopper 9 of the developer device 1 corresponding to the range L2 of the toner-supplementing cylindrical member 23'. In addition, the stepping motor 33 is stopped in its operation at the time when the toner-supplementing port 23*d* at a desired position is directed in a vertical downward direction and the toner 19 can be supplemented concentrically at the desired position.

Next, an operation of the device differing from that described above will be described as follows in reference to the case in which the toner-supplementing cylindrical member 23 of the toner-supplementing device 10-4 is applied.

In the case that a printing instruction for printing a printing medium 8 with a size of A4, for example, is outputted from the control means after installation of the developer device 1 and the toner cartridge 12 at the image forming device in the same manner as that of using the aforesaid toner-supplementing cylindrical member 23, turning-on of the power supply is turned on and supplementing of the toner 19 within the hopper 9 of the developer device 1 is completed, the stepping motor 38 is driven and a normal rotation or a reverse rotation of the stepping motor 33 is repeated within a range Q1 of the toner-supplementing cylindrical member 23 through a normal or reverse rotational driving of the stepping motor 33 in such a way that the toner-supplementing ports 23*d* arranged in a range P1 of the toner-supplementing cylindrical member 23 shown in FIG. 11 corresponding to a A4-size width while the coil spring 17 is being rotated in a downstream transferring direction of the toner. As a result, the toner 19 is supplemented within a range of the hopper 9 of the developer device 1 corresponding to the A4-size.

Next, in the case that the printing instruction for printing the B5-size printing medium 8 is outputted from the control means, a normal rotation or a reverse rotation in a range Q2 of the toner-supplementing cylindrical member 23 is repeated under a normal or reverse rotational driving operation of the stepping motor 33 in such a way that the toner-supplementing ports 23*d* arranged in a range P2 of the toner-supplementing cylindrical member 23 shown in FIG. 11 corresponding to a B5-size width while the coil spring 17 is being rotated in a downstream transferring direction of the toner in the same manner as that of the aforesaid A4-size printing. As a result, the toner 19 is supplemented in a range of the hopper 9 of the developer device 1 corresponding to B5-size.

Further, in the case that a printing instruction for printing the printing medium 8 corresponding to a postcard size is outputted, a normal rotation or a reverse rotation of the toner-supplementing cylindrical member 23 in a range Q3 is repeated within a range Q3 of the toner-supplementing cylindrical member 23 through a normal or reverse rotational driving of the stepping motor 33 in such a way that the toner-supplementing ports 23*d* arranged in a range P3 of the toner-supplementing cylindrical member 23 shown in FIG. 11 corresponding to a postcard-size width while the coil spring 17 is being rotated in a downstream transferring direction of the toner in the same manner as that of printing the A4-size printing medium. As a result, the toner 19 is supplemented in a range of the hopper 9 of the developer device 1 corresponding to the postcard-size.

In each of the operations of the aforesaid toner-supplementing device 10-4, a driving instruction for the stepping motor 33 or 38 outputted from the control means in correspondence with the case in which a size of the printing medium 8 is controlled in accordance with a program assembled in the control segment of the image forming device. Due to this fact, the toner in the toner-supplementing device 10-4 is supplied only to such a range as one adapted for a size of the printing medium 8, so that the toner is not uselessly consumed and its running cost can be saved.

Referring to FIG. 13, a toner-agitating member 50 of one embodiment of the present invention will be described as follows.

The toner-agitating member 50 is stored in the toner cartridge 12. The agitating member 50 has a connecting piece 52 fixed to a lower extremity end of an agitating coil 51 of a conical coil spring wound in a clockwise direction in a conical shape. Since a shape of the agitating coil 51 is selected as such a shape as one wound in compliance with an inner surface shape of the toner cartridge 12 as much as possible in such a way that the toner 19 in the toner cartridge 12 can be uniformly agitated, it is not necessarily restricted to the conical coil spring of the present invention, but there occurs sometimes that either a cylindrical shape or an irregular-shaped coil spring is applied. The connecting piece 52 has a pair of substantial half-circular plate members 53, 54. The plate members 53, 54 are provided with a slit-groove 55 at each of central parts and crossed at a right angle around the slit-groove 55 and fixed to each other. A vertical free height U1 of the toner-agitating member 50 is set to be longer by a predetermined length than a length U2 between a small protrusion 12*a* protruded in a ring-like shape inside the toner cartridge 12 and the supplying side connecting member 11 at the toner cartridge side. Although not shown, the supplying side connecting member 11 is punched with toner-supplying ports, and its lower surface is provided with a substantial semi-oblong shaped supplying port lid member, for example. It can be loaded to or unloaded from it, the lid member can be opened or closed, the lid is sealingly closed when the lid is not fitted to the developer device 1 and the lid can be held under its released state after its installing to the developer device 1. However, the present invention is not limited to this constitution.

In turn, it is also preferable that a substantial semi-oblong shaped receiving port lid member which can be loaded to or unloaded from it, for example, is similarly arranged below the receiving port 1*d* at the developer device 1. In turn, as shown in FIG. 13(*c*), one end of an upstream side of the coil spring 17 is formed with an engaging segment 17*b* where an end part of a wire material wound in a coil shape continuously extends, traverses in a linear-form through the center of the coil spring 17 and partitions it into a semi-circular shape.

Then, operation of the toner-agitating member 50 will be described as follows.

When the toner cartridge 12 is installed at the developer device 1 arranged at the image-forming device, the supplying port lid member and the receiving port lid member at the lower surface of the supplying side connecting member 11 are released, the agitating coil 51 of the toner-agitating member 50 extends from the toner-supplying port, the engaging part 17*b* of the coil spring 17 enters into the slit-groove 55*a* of the connecting piece 52. As the coil spring 17 is rotated as already been described in reference to the operations of the aforesaid toner-supplementing devices 10-1 to 10-4, the agitating coil 51 is rotated through the connecting piece 52 under the rotational force of the coil spring and the toner 19 within the toner cartridge 12 can be uniformly agitated and its solidification can be prevented. In addition, even in the case that the engaging part 17*b* does not enter into the slit-groove 55*a* when the toner cartridge 12 is installed at the developer device 1 and the supplying port lid member at the lower surface is released, the coil spring 17 starts to rotate, resulting in that the slit-groove 55*a* and the engaging part 17*b* are engaged to each other to cause the agitating coil 51 to be rotated and the toner 19 to be started to rotate.

In turn, in the case that the toner cartridge 12 is to be replaced with a new product, the supplying port lid member at the lower surface of the supplying side connecting member 11 is closed to cause it to slide on an arcuate outer shape of each of the substantial semi-circular plate members 53, 54 of the connecting piece 52 and push up the toner-agitating member 50 and then it can be easily retracted into the toner cartridge 12.

EFFECTS OF THE PRESENT INVENTION

In accordance with the toner-supplementing device of claims 1 to 3 of the present invention, the toner-storing segment cannot be arranged at the upper part of the developer device, but can be arranged at another location and the toner can be uniformly supplemented in a desired range in an axial direction of the toner-transferring roller.

In accordance with the toner-supplementing device of claims 4 to 6 of the present invention, in addition to the merit of the location where the toner storing segment of the toner-supplementing device of claims 1 to 3, the toner can be supplemented uniformly and only by a requisite amount over a range in an axial direction of the toner-transferring roller corresponding to a size of the medium to be printed. Accordingly, the device is small in size, its cost is low, its operation, repairing and maintenance work as well as its image quality are superior and no dispersion of toner supplying operation occurs.

In addition, in accordance with the toner-agitating member of claims 7 and 8 of the present invention, its structure is simple, its operation is superior, deterioration or solidification caused by excessive agitation of the toner can be prevented and the device is superior in view of its cost, operation and image quality.

Although the present invention has been described with reference to the preferred embodiments, it is apparent that the present invention is not limited to the aforesaid preferred embodiments, but various modifications can be attained without departing from its scope.

What is claimed is:

1. A toner-supplementing device in which a toner-storing segment is placed outside an image-forming range of an image-forming device, toner is transferred from the toner-storing segment to a toner-supplementing segment of a developer device and the toner is supplemented to a toner-supplementing area having a predetermined width at the toner-supplementing segment, wherein there are provided:

a conduit having an upstream side one end fixed to the developer device;

a cylindrical member closely contacted with the other end of the conduit, rotatable around its axis, and having a desired number of small slit-like toner-supplementing ports which have their center being placed on an inclined line in respect to an axial direction in a developed plane of a circumferential wall and are punched with their phase being displaced in a circumferential direction and in parallel with the axial direction; and a toner-transferring member for transferring toner from the upstream one end toward the other downstream end inside the toner-supplementing cylindrical member.

2. The toner-supplementing device according to claim 1, wherein the toner-supplementing ports are punched in a substantial equal-spaced apart relation in an axial direction on an inclined line in one direction of a circumferential wall of the toner-supplementing cylindrical member and with their phases being displaced substantially equally in a circumferential direction.

3. The toner-supplementing device according to claim 1, wherein a helical toner-feeding protrusion of slight height is protruded between each of the toner-supplementing ports at the circumferential wall of the toner-supplementing cylindrical member.

4. The toner-supplementing device according to claim 2, wherein the toner-supplementing cylindrical member is a conical cylinder with its diameter being gradually decreased from one end toward a downstream direction or a cylinder having the same diameter over its entire length and inclined with its circumferential wall being descended toward the downstream direction.

5. The toner-supplementing device according to claim 1, wherein a coil spring is extended within the conduit and the toner-supplementing cylindrical member and can be cooperatively related with the toner-supplementing cylindrical member.

6. The toner-supplementing device according to claim 5, wherein an auger is extended in place of the coil spring in the toner-supplementing cylindrical member.

7. The toner-supplementing device according to claim 5, wherein a partition wall formed with an opening corresponding to a toner-supplementing area is arranged while a slight clearance being arranged between the toner-supplementing segment and the toner-supplementing cylindrical member of the developer device, and there is provided an area not punched with a toner-supplementing port having a width slightly larger than a circumferential width of the partition wall in a circumferential direction of the toner-supplementing cylindrical member.

8. The toner-supplementing device according to claim 7, wherein a pipe member having a diameter slightly larger than that of the toner-supplementing cylindrical member formed with an opening corresponding to the toner-supplementing area is immovably fixed in place of the partition wall and the toner-supplementing cylindrical member is caught in and attached to the pipe member.

9. The toner-supplementing device according to claim 7, wherein the toner-supplementing ports in an axial direction of the toner-supplementing cylindrical member are arranged in response to a plurality of sizes of a printing medium applied to the developer device, they are spaced apart with an area not punched with toner-supplementing ports being placed at the midway part and have a difference in range in an axial direction.

10. The toner-supplementing device according to claim 9, wherein a size of the printing medium is detected and either a wide range or narrow range of the toner-supplementing ports can be selected and controlled in accordance with a program loaded in a control segment of an image forming device.

11. A toner-agitating member in which an agitating coil of a coil spring having an outer edge shape extending along an inner surface of a toner-storing segment and rotatable around its axis is stored in the toner-storing segment under its compressed state, a connecting member punched with an openable or closable toner-supplying port is arranged at the extremity end of the toner-storing segment, the toner-supplying port is closed and the agitating coil is stored in the toner-storing segment when the toner-storing segment is not installed at a developer device, and the toner-supplying port is released when the toner-storing segment is installed at the developer device to enable the extremity end of the agitating coil to be protruded.

12. The toner-agitating member according to claim 11, wherein an end part of a coil-shaped wire member is continuous to one upstream end of the coil spring of the toner-supplementing device according to any one of claims 1 to 10, an engaging segment traversing in a linear line manner across the center of the coil spring to divide it is formed in the coil-shaped wire member, a connecting piece fixed to the extremity end of the agitating coil is formed in such a way that a slit-groove is arranged at each of the central parts of a pair of substantial semi-circular plate members and the plate members are crossed and fixed at a right angle around the slit-groove applied as a center, the engaging segment is entered into the slit-groove protruded from the toner-supplying port when the toner-storing segment is installed into the developer device, and the agitating coil can be rotated in cooperation with a turning of the coil spring.

* * * * *